United States Patent [19]

Drummond

[11] 4,189,110

[45] Feb. 19, 1980

[54] CREEL

[75] Inventor: Warren W. Drummond, Allison Park, Pa.

[73] Assignee: PPG Industries, Inc., Pittsburgh, Pa.

[21] Appl. No.: 968,336

[22] Filed: Dec. 11, 1978

[51] Int. Cl.[2] ..... B65H 49/02

[52] U.S. Cl. ..... 242/131

[58] Field of Search ..... 242/131, 131.1, 140, 242/141, 146, 153; 57/157 R, 157 F; 65/2, 11 R, 11 W

[56] References Cited

U.S. PATENT DOCUMENTS

| | | | |
|---|---|---|---|
| 1,765,590 | 6/1930 | Javery | 242/131.1 |
| 3,151,963 | 10/1965 | Cochran | 65/11 W |
| 3,535,097 | 10/1970 | Drummond | 65/2 |
| 3,545,699 | 12/1970 | Klink et al. | 242/153 |
| 3,674,223 | 7/1972 | Philip | 242/131 |
| 4,045,195 | 8/1977 | Drummond | 65/2 |
| 4,096,687 | 6/1978 | McDonald | 57/157 F |

OTHER PUBLICATIONS

Manufacturing Technology of Continuous Glass Fibers, K. Lowenstein, Elsevier Publishing Co. 1973, p. 256.

*Primary Examiner*—Leonard D. Christian
*Attorney, Agent, or Firm*—John E. Curley

[57] ABSTRACT

A creel for unwinding forming packages of strand is described in which a plurality of vertically spaced flat shelves are mounted on a frame with rows of orifices provided on each of the shelves. The orifices are spaced apart on said shelves a sufficient distance from each other to permit a forming package to be placed over each orifice without touching an adjacent forming package. A sleeve is positioned in each orifice and constructed to permit strand to run through it without damaging the strand and a guide eye is positioned below each sleeve and free of the side of the shelf holding the sleeve to guide strand drawn through it to a point beyond the creel without touching the creel shelves.

4 Claims, 2 Drawing Figures

CREEL

BACKGROUND OF THE INVENTION

In the production of various glass fiber containing products such as glass rovings, continuous strand glass mats, coated glass cords for application in reinforcing tires and the like, packages of glass strand are utilized as feed to the secondary processes. Thus, in the manufacture of rovings, for example, many packages of fiber glass yarns are utilized in the preparation of a roving by combining several of these strands and running them in parallel on a rewinding machine to combine them as a roving product. A process such as this is generally described in U.S. Pat. No. 3,545,699. Another process is illustrated in U.S. Pat. No. 3,740,257 where a plurality of strands are utilized to provide a coated yarn for use in reinforcing rubber tire stock.

In most of these secondary operations it is common to place several forming packages of the strand on a creel, the creel being provided with cradles shaped similar to the outside diameter of the forming package so that the forming package can be placed on the creel and nested thereon while yarn is being withdrawn from the creel and passed into the secondary operation. In rewinding operations it is common to utilize such creels, for example, to place multiple ends of glass yarn on beams utilized by the textile industry in the manufacture of textile cloth. Normally in a roving operation where a multiplicity of forming packages are mounted on a creel to prepare roving, the strand is drawn from the inside of the package through suitable tensioning devices to the roving machine. An illustration of such an operation is also shown on page 256 of THE MANUFACTURING TECHNOLOGY OF CONTINUOUS GLASS FIBERS, K. L. Loewenstein, Elsevier Publishing Company, 1973. In some instances it is desirable to remove the yarn from the outside of the forming package when it is creeled. An illustration of an operation of this character is shown in U.S. Pat. No. 4,096,687. As will be noted in that patent, provision is made in such an instance to insure easy withdrawal by applying shields on the outside of the creel around which the yarn must pass during its removal from the forming package.

Normally in the production of fiber glass strands, forming packages are generally barrel shaped due to the manner in which they are formed. Thus, the packages take a generally barrel shaped form with a feathered edge. If desired, however, forming packages can be produced which possess on the inside and the outside of the package a generally flat surface. Thus, by the utilization of stroke shortening techniques packages can be made which are heavier than normal forming packages without producing a feathered edge package thereon. These packages are provided by the utilization of stroke shortening techniques common in the art and which are generally described in U.S. Pat. Nos. 3,151,963 and 3,535,097. Further, in utilizing stroke shortening to provide more or less cylindrical packages with flat interior and exterior surfaces and stroke shortening procedures, several small packages of considerable weight, 20 to 40 pounds (9 to 18 kilograms) a piece can be produced on a single conventional forming collet, generally in the manner as shown in FIG. 6 of U.S. Pat. No. 4,045,195.

In some fabrication operations using fiber glass materials from forming package feeds, it is desirable to utilize wet forming packages. It has been found that in utilizing strands from forming packages which contain considerable quantities of moisture, i.e., 3 percent or more, that difficulties are encountered utilizing creel mechanisms of the conventional type, i.e., creels which nest the forming package in a cradle or on which the forming package is mounted by placing the package on an arm located on the creel and unwinding from the outside. Generally the difficulty is exhibited by a sloughing of the damp yarn from the ends of the package as it is being withdrawn from a forming package mounted in a cradle on a conventional creel such as those shown in the Loewenstein reference above recited.

THE PRESENT INVENTION

By virtue of the instant invention wet forming packages can be unwound with little or no difficulty by utilizing a novel creel that provides distinct advantages over those heretofore utilized in the prior art. Thus, a creel is provided which is constructed of a frame member having a plurality of vertically stacked shelves thereon; each of the shelves being provided with one or more rows of orifices or holes therein. The orifices have inserted in them a sleeve member which carries on either end a small lip or collar and is constructed of a suitable material through which glass yarn can pass without damage. Located below the bottom of each of the shelves on the creel and spaced slightly from the edge of the shelves is a guide eye corresponding to each of the orifices contained on the shelves and through which yarn may pass free of the shelves to the secondary forming operation. By utilizing stroke shortened packages that may be placed on their ends rather than mounted in cradles on their sides, a multiplicity of packages can be placed on a small creeling unit and satisfactorily withdrawn whether they are wet or dry.

DETAILED DESCRIPTION OF THE INVENTION

Figure 1:
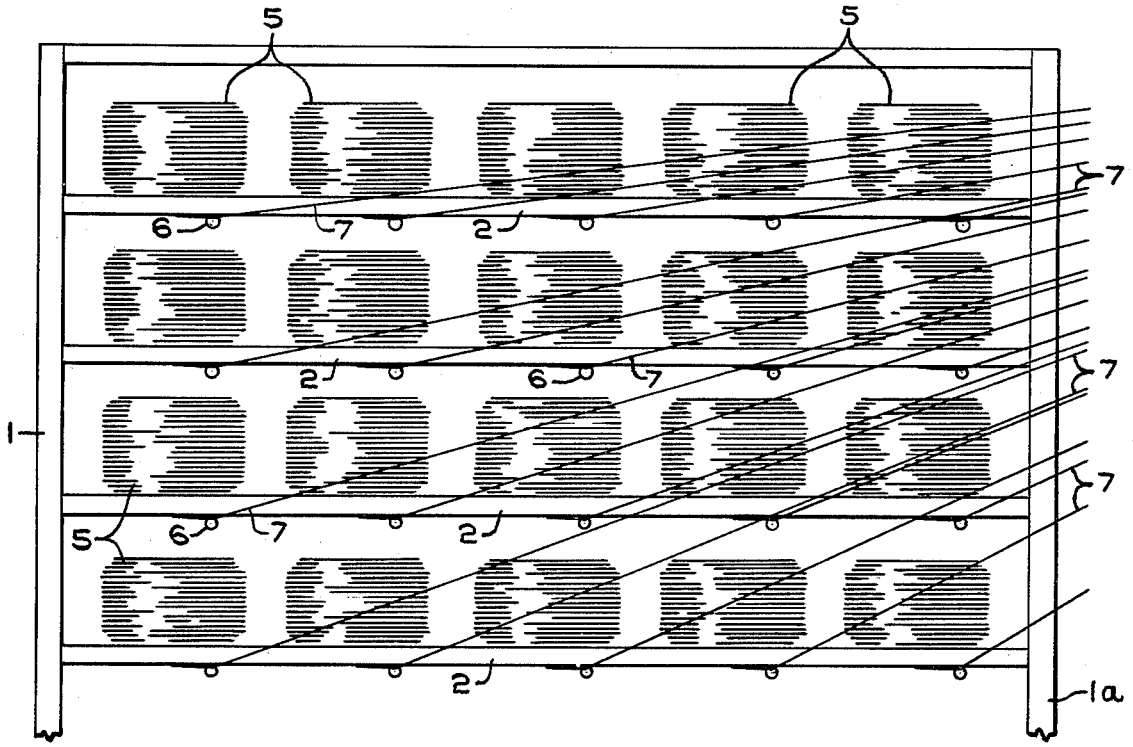
Figure 2:
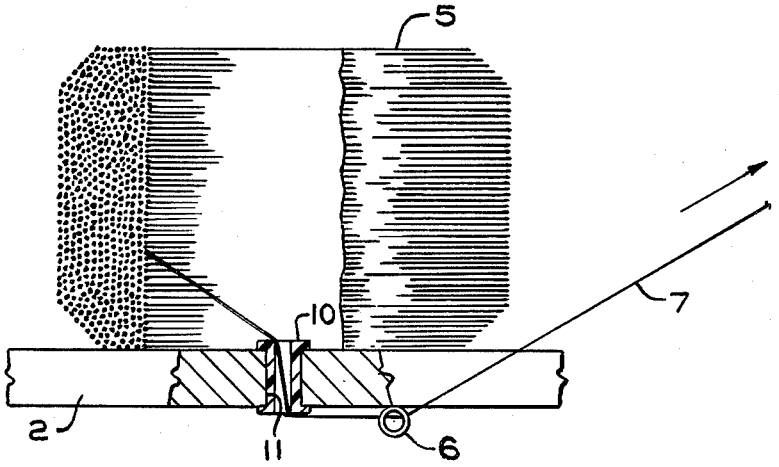

The invention will now be described with reference to the drawing contained herein in which:

FIG. 1 is a side view of the novel creel of the instant invention showing a plurality of packages in place; and FIG. 2 is a sectional view of one package and a small section of one of the shelves shown in FIG. 1 to depict the detail of the orifice and shelf and guide eye arrangement.

As can be seen, the creel arrangement involves a creel frame composed of vertical supports 1 and 1*a* which support and carry a plurality of shelf members 2. Placed on each of the shelves are a plurality of forming packages 5 which have been stroke shortened so that they do not have to be laid upon a feathered edge as a normal forming package would be. Projecting slightly from the side surface of the shelves 2 are a plurality of guide eyes 6 which are spaced from the side of shelf 2 and located slightly below it.

As seen in more detail in FIG. 2, a strand is drawn from the inside of the forming package 5 and passed down through the orifice 11 which is lined with a sleeve member 10 that is provided with a lip 10*a* on the upper surface thereof and lip 10*b* on the lower surface thereof to completely surround the shelf material located in the area of the orifice 11. The strand 7 is drawn through the sleeve member 10 over the surfaces of the lips 10*a* and 10*b* and moved underneath shelf 2 to the guide eye 6 which is as previously stated is spaced a slight distance from the edge of the shelf 2 to permit strand 7 to be drawn through guide eye 6 to the secondary fabrication operation free and clear of any contact with the shelf to itself.

The sleeve 10 and its associated lips 10*a* and 10*b* can be constructed of any suitable material which is not detrimental to glass strand when it is in contact with the surface thereof. Suitable materials for this purpose can be graphite, nylon, teflon, polyvinylchloride and other suitable smooth-surfaced materials which will not abrade the glass during its passage through orifice 11 and its contact with the associated sleeve 10 and lips 10*a* and 10*b*. The creel can be constructed of any suitable structural material and in general sheet metal can be utilized for the frame members 1*a* and 1*b* of which there are obviously four, and only two shown in FIG. 1. The flat shelf can be constructed of any suitable smooth-surfaced composition and material such as stainless steel, smooth-surfaced micarta board and AZDEL® sheet have been found particularly useful.

As will be readily understood by the skilled artisan, the creel itself may be moved by providing suitable rollers on the bottom of the frame so that it can be moved close to the work area in which the secondary operation is to take place. Also, since the forming packages are placed on a flat shelf surface, the width and strength of the shelf is the determining factor in the number of packages that may be stored on a shelf at a given time. Thus, if desired the five rows of forming packages shown on each of the shelves in FIG. 1 can contain across the width of the shelf several rows of forming packages. In this instance the orifices in the back rows may be staggered and guide eyes provided similar to guide eye 6 so that the strands and the packages to the rear of those shown in FIG. 1 can be unwound and the strands removed without touching adjacent strands being removed from the first row. Thus, a compact creel is provided which can contain very large numbers of forming packages of considerable weight so that a secondary operation such as the production of roving or the production of continuous strand mat can be conducted for long periods of time without the requirement for recreeling.

Thus, utilizing the novel creel of the instant invention, large numbers of forming packages can be placed close to the work area and considerable space saved as a result. In creeling packages that are laid on their sides as shown by the Loewenstein reference, it is often a requirement the strands be located at a considerable distance from the work area depending upon the number of creel packages required for that operation. Since the creels are placed in side by side relationship with packages mounted on their sides in long rows utilizing the instant invention, creels can be placed close to the fabrication machinery and drawn but a short distance from the creel to the ultimate fabrication operation.

While the invention has been described with reference to certain specific examples and illustrative embodiments, it is not intended to be limited thereby except insofar as appears in the accompanying claims.

I claim:

1. A creel for unwinding forming packages of strand comprising a frame member, a plurality of flat surfaced shelves mounted on said frame and spaced apart from each other, said shelves being spaced a sufficient distance apart to permit a forming package to be placed on its end on a shelf without contacting the next adjacent shelf, a plurality of spaced apart orifices in each of said shelves, said orifices being spaced so that a forming package can be placed over each said orifice without touching an adjacent forming package, a sleeve in each of said orifices constructed to permit strand to run therethrough and a guide eye spaced from one side of each shelf opposite each orifice and in a plane slightly below the bottom surface of said shelves to permit strand to be drawn between the exit of said sleeve and said guide eye free of contact with said shelf.

2. A creel for unwinding forming packages of strand comprising a frame member, a plurality of vertically spaced flat shelves mounted on said frame, rows of orifices provided on each of said shelves, said orifices being spaced apart on said shelves a sufficient distance from each other to permit a forming package to be placed over each orifice without touching an adjacent forming package, a sleeve positioned in each orifice constructed to permit strand to run through it without damaging the strand and a guide eye positioned below each sleeve and free of the side of the shelf holding said sleeve to guide strand drawn through it to a point beyond the creel without touching the creel shelves.

3. The apparatus of claim 1 wherein said sleeve is provided with a lip on the upper and lower side of each orifice to prevent strand from contacting the upper or lower surface of said shelf.

4. The apparatus of claim 2 wherein said sleeve is provided with a lip on the upper and lower side of each of said orifices to prevent strand from directly contacting the upper or lower surface of said shelf.

* * * * *